US005198155A

United States Patent [19]

Etzweiler et al.

[11] Patent Number: 5,198,155

[45] Date of Patent: Mar. 30, 1993

[54] APPARATUS FOR THE ADMIXING OF GASEOUS OR VAPOROUS SUBSTANCES

[75] Inventors: Franz Etzweiler, Greifensee; Norbert Neuner-Jehle, Jona, both of Switzerland

[73] Assignee: Givaudan Corporation, Clifton, N.J.

[21] Appl. No.: 731,678

[22] Filed: Jul. 17, 1991

[30] Foreign Application Priority Data

Jul. 31, 1990 [CH] Switzerland ..... 2517/90

[51] Int. Cl.[5] ..... B01F 3/04

[52] U.S. Cl. ..... 261/18.1; 261/64.1; 261/82; 73/23.34

[58] Field of Search ..... 73/23.34; 261/18.1, 261/64.1, 82

[56] References Cited

U.S. PATENT DOCUMENTS

| | | | |
|---|---|---|---|
| 2,950,618 | 8/1960 | Lewis | 73/23.34 |
| 3,902,851 | 9/1975 | Dravieks | 73/23.34 |
| 4,053,283 | 10/1977 | Schneider et al. | 261/82 |
| 4,263,166 | 4/1981 | Adams | 261/18.1 |
| 4,470,938 | 9/1984 | Johnson | 261/82 |
| 4,520,651 | 6/1985 | Litman . | |
| 4,554,820 | 11/1985 | Litman . | |
| 4,563,893 | 1/1986 | Tanyolac et al. | 73/23.34 |
| 5,023,020 | 6/1991 | Machida et al. | 261/18.1 |

OTHER PUBLICATIONS

I. Litman, Perfumer & Flavorist, 10 (1985) 91-92.

A. Dravnieks, "Instrumental Aspects of Olfactometry" in "Methods of Olfactory Research", London, N.Y., San Francisco, 1975, pp. 1-61.

H. R. Moskowitz et al., J. Soc. Cosmet. Chem., 30 (1979) 91, 99.

*Primary Examiner*—Tim Miles

*Attorney, Agent, or Firm*—Robert F. Tavares; Linda A. Vag

[57] ABSTRACT

For admixing a gaseous substance, especially an odoriferous substance, into a gas stream. The gaseous substance is fed by means of a carrier gas (23) via a line (10) to a mixing chamber (1). The line contains at least one capillary (19), which is arranged in an advancing device (9) with two defined positions. In a first position the capillary extends through an opening (6), into the mixing chamber. In a second position the capillary opens outside of the mixing chamber in a suction removal space (25) surrounding the mixing chamber. Preferably the carrier gas is flowing continuously and suction removal means (26) are provided which remove the carrier gas together with the gaseous substance when the capillary opens in the suction removal space.

9 Claims, 1 Drawing Sheet

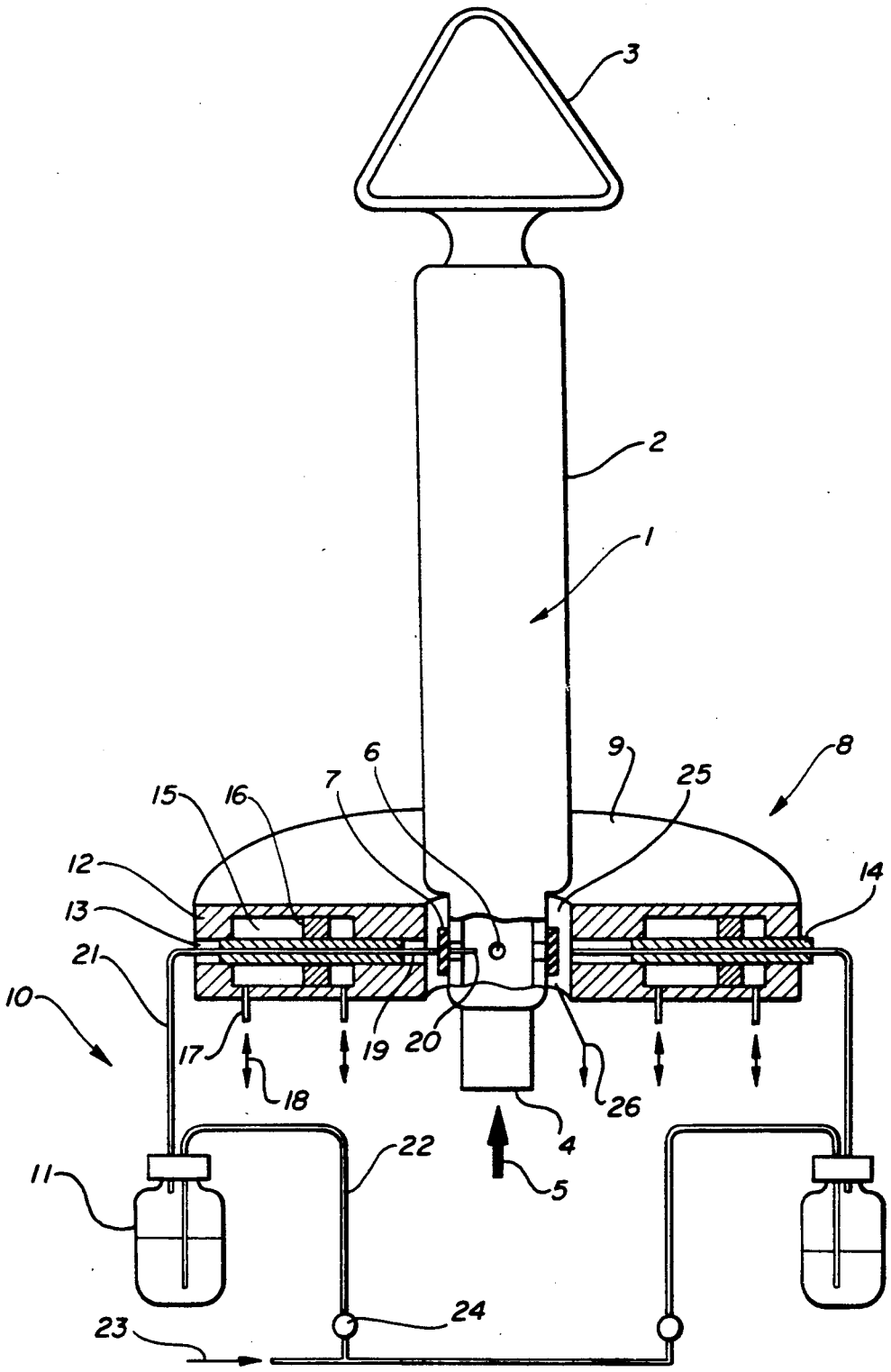
3
2
1
6
9
8
7
25
15
16
12
14
13
21
10
17
19
20
18
26
4
22
5
11
24
23

APPARATUS FOR THE ADMIXING OF GASEOUS OR VAPOROUS SUBSTANCES

BACKGROUND OF THE INVENTION

1. Field of the Invention

The invention relates to an apparatus for the admixing of a gaseous or vaporous substance, especially an odoriferous substance, into a gas stream in a mixing chamber, to which the gaseous or vaporous substance is fed by means of a carrier gas via a line.

2. Background Information

An apparatus for the mixing of odoriferous substances is taught in U.S. Pat. No. 4,520,651. In this apparatus, the vapors of the odoriferous substances are individually mixed with odorless carrier gas. These individual gas mixtures are then brought together in a mixing chamber in order to produce an odoriferous substance composition. The lines which lead the odorless gas to storage tanks containing the odoriferous substances have controllable valves: a shut off valve with which the odorless gas can be switched on and off and an adjusting valve with which the quantity of gas can be individually controlled.

This prior art apparatus has the disadvantage that when opening the valves, i.e., when switching in an individual odoriferous substance component or else when increasing the concentration in the lines, the surfaces first have to be saturated. The concentration of the odoriferous substance in the mixing chamber increases slowly until reaching a state of equilibrium. Conversely, during switching-out so-called memory effects occur, since odoriferous substances desorbing from the surfaces can get into the mixing chamber by diffusion. There is a relatively long waiting time until in each instance a state of equilibrium is reached and an assessment of the odor of the composition can be carried out.

A further disadvantage of the known mixing apparatus is that measurements of odor threshold values, at which precisely defined quantities of a gas saturated with odoriferous substance can be added to an odorless rarefaction gas, are not possible.

SUMMARY OF THE INVENTION

The object of the invention is to provide an apparatus with which both odoriferous substance mixtures can be produced, or varied quickly and reproducibly, and threshold value determinations can be carried out easily and precisely.

According to the invention, this object is achieved by an apparatus of the type mentioned above, i.e., an apparatus which feeds the substance into a gas stream in a mixing chamber by means of a carrier gas via a line. This apparatus is distinguished by the fact that the line contains a capillary, which is arranged in an advancing device with two defined positions. In a first position the capillary extends into the interior of the mixing chamber through an opening of the mixing chamber, said opening provided with shut-off means. In the second position the capillary opens outside the mixing chamber in a suction removal space surrounding the mixing chamber.

BRIEF DESCRIPTION OF THE DRAWING

The single figure of the drawing shows, partly in perspective representation and partly in section, an apparatus for the admixing of a plurality of odoriferous substances into a gas stream.

DESCRIPTION OF THE PREFERRED EMBODIMENTS

According to a preferred embodiment of the invention, the line for feeding the substance into the mixing chamber, including its moving parts, comprises a metal capillary and has the carrier gas saturated with the gaseous substance continuously flowing through it. The advancing device may preferably be a pneumatically operated piston in a cylinder. The shut-off means of the opening of the mixing chamber expediently comprise a flexible diaphragm. From the suction removal space surrounding the mixing chamber, the air, or the mixture of air, carrier gas and the gaseous substance produced there, is expediently removed continuously by suction.

A special embodiment serves for the production of a mixture of a plurality of odoriferous substances in one gas stream and for this purpose has a plurality of lines with capillaries and a corresponding number of advancing devices and of openings into the mixing chamber, said openings provided with shut-off means.

This apparatus can also be used for the so-called threshold value determination, by only a single odoriferous substance being fed in and varied in its concentration. An apparatus which is used exclusively for threshold value determination is constructed on the same principle as the embodiment described below.

A preferred exemplary embodiment of the invention is described below with reference to the attached drawing.

In the case of the apparatus shown in the drawing, the mixtures are produced in a mixing chamber 1, which essentially comprises an elongated tube 2, which is open at both ends, at the upper end of which the opening 3 is widened into a triangular shape adapted to the human nose. A continuous air stream 5 is fed in through the lower opening 4. The stream expediently corresponds to the rate usual for normal breathing of about 8 to 10 liters per minute.

The mixing chamber preferably consists of glass. In its lower part, it has a series of openings 6, which are arranged at the same height and are distributed evenly around the circumference. Alternatively, the openings may also be arranged at different heights, in particular on two levels, if more openings are provided than there is room for on one level. The openings are covered by a flexible diaphragm 7. The diaphragm consists, for example, of rubber and has the characteristic that it closes again after perforation by a needle and withdrawal of the needle.

The covering of the openings 6 may also be effected by other mechanical devices instead of membranes, such as flaps etc., or may be entirely omitted if the diameter of the openings is sufficiently narrow.

Arranged around the lower part of the mixing chamber, provided with the openings 6, is a feed system 8 for the odoriferous substance components which are mixed in the mixing chamber. The feed system 8 essentially comprises an advancing device 9 and a line system 10 for supplying odoriferous substance components from storage tanks 11 to the mixing chamber 1.

The advancing device 9 comprises an annular housing 12, in which bores 13 are arranged evenly around the circumference, distributed at the same angular positions as the openings 6, in which bores push rods 14 are disposed in an axially displaceable manner. In the inner housing area, the bores 13 are widened into chambers 15 of greater cross-section, which have the function of cylinders. The push rods 14 are surrounded approximately in their center by an annular, sleeve-like piston 16, which divides the chambers 15 into two parts, separated airtightly from each other. To each of the two parts there leads a supply line 17, via which compressed air is alternately fed in, in order to move within the cylinder 15 the pistons 16, and consequently the push rods 14, pneumatically in one direction or the other. The compressed air feeding is symbolized by the arrows 18.

The push rods 14 are provided with central axial bores, in which capillaries 19 are arranged. On the side of the push rods facing the mixing chamber, the capillaries protrude far enough beyond the push rods that their end 20 projects into the mixing chamber when, as shown on the left side of the figure, the push rod is pneumatically pushed inwards, while the end 20 remains outside the mixing chamber, as shown on the right side, when the push rod is pneumatically displaced outwards.

As an alternative to pneumatic operation, a mechanical, electromechanical or hydraulic operation of the advancing device may also be provided. This structural design of these alternative possibilities does not make any special demands on a person skilled in the art.

The capillaries 19 are connected by lines 21 to the already mentioned storage vessels 11 for the odoriferous substance. In the case of the present exemplary embodiment, the capillaries 19 and the associated moving connecting lines 21 in each case comprise a single steel capillary. If required, a different metal, for example platinum, may also be provided.

Via a feed line 22, an inert carrier gas, for example nitrogen, which is symbolized by the arrow 23, is passed to the storage tanks 11. Valves 24, with which the carrier gas stream can be metered, are arranged in lines 22.

Between the mixing chamber 1 and the advancing device 9 there is provided a suction removal space 25, in which the capillary orifices are located when they are pushed outwards by the push rod 14. From this suction removal space 25, the air, or an air/odoriferous substance mixture produced there, is continuously removed by suction, as symbolized by the arrow 26.

For the production of an odoriferous substance composition of, for example, up to twelve components, which may for their part already represent mixtures, the apparatus has twelve openings 6 and, accordingly, the advancing device also has twelve pneumatic cylinders 15 with push rods 14 and the associated capillaries 19, which are connected in each case to corresponding storage vessels 11. For the components which are to be involved in the mixing, the capillary orifices are pushed by the advancing device into the mixing chamber. The continuous gas stream of carrier gas and odoriferous substance passes into the main air stream 5 which is flowing through the mixing chamber. All other capillaries of which the associated components are not to pass into the mixture but which will be needed later during the course of the series of tests, likewise have carrier gas with odoriferous substance flowing continuously through them, but this goes into the suction removal space and is removed by suction. When a component is then additionally to pass into the mixture, the corresponding capillary is pushed into the mixing chamber by means of the advancing device as a result of which the component is immediately available in the desired constant concentration.

The concentration of the individual components is controlled via the flow of the carrier gas 23, i.e. by means of the valve 24. The valve 24 permits a control of the nitrogen stream between 0 and 1,000 ml per minute. If required, greater flows of several liters per minute may also be provided by suitable choice of the capillaries and valves.

As already mentioned, the apparatus has the advantage that, due to the continuous through-flow of the capillary lines with the mixture of carrier gas and odoriferous substance, the problem of adsorption or desorption on the inner surfaces of the lines is eliminated. This has the consequence that the set odoriferous substance concentrations are always in equilibrium in the channels and consequently always exhibit constant values. Furthermore, no so-called memory effect can occur when a channel is switched off. In addition, by the method of pushing in the capillaries into the mixing chamber or withdrawing them from the mixing chamber, the intended mixing ratio is achieved virtually instantaneously, i.e. significantly quicker than with previously known methods.

We claim:

1. An apparatus for the admixing of a gaseous or vaporous substance into a gas stream in a mixing chamber (1), wherein the gaseous or vaporous substance is fed by means of a carrier gas (23) via a line (10), characterized in that said line contains a capillary (19), wherein said capillary is arranged in an advancing device (9) with two defined positions, such that in a first position said capillary extends through an opening (6) of said mixing chamber into the interior of said mixing chamber and in a second position said capillary opens outside said mixing chamber in a suction removal space (25) surrounding said mixing chamber.

2. An apparatus according to claim 1 wherein the substance to be admixed is an odoriferous substance.

3. An apparatus according to claims 1 or 2 characterized in that said carrier gas (23) flows continuously.

4. An apparatus according to claims 1 or 2 characterized in that suction removal means (26) is provided to remove said carrier gas and said gaseous or vaporous substance from said capillary when said capillary is in said second position.

5. A device according to claims 1 or 2 characterized in that said line (10) comprises a continuous metal capillary.

6. A device according to claims 1 or 2 characterized in that said advancing device (9) comprises a piston (14,16) movable in a cylinder (15).

7. A device according to claims 1 or 2 characterized in that said opening is provided with shut-off means (7).

8. A device according to claim 7 wherein said shut-off means comprises a flexible diaphragm.

9. A device according to claims 1 or 2 characterized in that a plurality of lines (10) are provided.

* * * * *